US007698841B1

(12) United States Patent
Vivat

(10) Patent No.: US 7,698,841 B1
(45) Date of Patent: Apr. 20, 2010

(54) SINGING AND ANIMATED BIRTHDAY CAKE

(76) Inventor: Alon Vivat, 510 W. 6th St., Suite 532, Los Angeles, CA (US) 90014

( * ) Notice: Subject to any disclaimer, the term of this patent is extended or adjusted under 35 U.S.C. 154(b) by 0 days.

(21) Appl. No.: 12/290,356

(22) Filed: Oct. 30, 2008

(51) Int. Cl.
*A63H 3/28* (2006.01)
*A63H 3/38* (2006.01)

(52) U.S. Cl. ..... 40/416; 446/301; 446/343; 446/345; 446/392

(58) Field of Classification Search ..... 40/416; 446/391, 392, 393, 395, 342, 343, 345, 348, 446/301
See application file for complete search history.

(56) References Cited

U.S. PATENT DOCUMENTS 754,825 A * 3/1904 Spencer et al. ..... 40/455
1,804,297 A * 5/1931 Wintz ..... 40/455
3,308,705 A 3/1967 Shinnick
4,416,075 A 11/1983 Bauer
4,702,140 A 10/1987 Goldfarb
4,721,437 A * 1/1988 Mitamura et al. ..... 379/388.02
4,801,478 A 1/1989 Greenblatt
4,850,930 A * 7/1989 Sato et al. ..... 446/175
4,947,722 A 8/1990 Lewis
5,673,802 A 10/1997 Valentino
6,386,942 B1 * 5/2002 Tang ..... 446/301
6,796,872 B2 9/2004 Herber
6,988,928 B2 * 1/2006 Willett ..... 446/330
2005/0246928 A1 11/2005 Lee

* cited by examiner

*Primary Examiner*—Cassandra Davis

(57) ABSTRACT

A versatile, animated cake decoration that can be used with a cake to celebrate various occasions such as birthdays, anniversaries, graduations and the like. The cake decoration can be partially embedded in the upper surface of the cake so as to simulate a face that has moving eyes and a moving mouth. The apparatus includes a battery that powers a mechanism that moves the eyes and the mouth and also powers a sound generator that can play a number of different songs and greetings to fit the celebration. The apparatus is safe and is constructed from non-toxic materials so it can safely be used on food products such as cake.

10 Claims, 3 Drawing Sheets

SINGING AND ANIMATED BIRTHDAY CAKE

BACKGROUND OF THE INVENTION

1. Field of the Invention

The present invention relates to animated cake decorations. More particularly, the invention concerns a novel cake decoration that simulates a face and has moving eyes and a moving mouth. Additionally, the apparatus includes a battery powered sound generator that can play a number of different songs and greetings. The apparatus is adapted to be partially embedded in the center of celebration cakes of various kinds as, for example, birthday, anniversary and graduation cakes.

2. Discussion of the Prior Art

It is common practice to use cakes to celebrate special occasions such as birthdays, anniversaries, graduations, Halloween and like events. Typically, such cakes are decorated with candles and with words and symbols applicable to the occasion, such as "Happy Birthday" and "Happy Anniversary". Often, following lighting of the candles, songs are also sung to further celebrate the occasion.

Providing animated, mechanically operated decorations for use in connection with cakes is not new. For example, U.S. Pat. No. 6,796,872 issued to Herber discloses a pop-up device that may be placed in a hollow section of a cake, which is later iced over so that the candle holder is not visible. In the preferred embodiment, the base of the device supports the pop-up mechanism within a housing. The device is held in a compressed state by a release mechanism. Upon triggering of the release mechanism, the device is released and pushed through the cake or other confection, thereby providing surprise and entertainment.

It is also not new to provide animated cake decorations that play music. By a way of example, United States Patent to Valentino No. 5,673,802 describes a rotatable holder for a candle on a cake. Within the housing of the device is a small, battery powered D.C. motor connected through reduction gearing to a shaft, and audio may be provided so that when rotating the shaft an appropriate melody can be played. The holder is fixedly secured to the cake by means of a plurality of prongs.

A drawback of many of the prior art cake decorations is that they tend to be quite complex in construction and, therefore, often quite expensive to manufacture. Additionally, such prior art devices tend to be unreliable in use and frequently can be used only for one occasion.

It is these drawbacks that the device of the present invention seeks to overcome by providing a unique cake decoration that is relatively simple in construction, can be inexpensively manufactured and that can be used over and over for various types of celebrations.

SUMMARY OF THE INVENTION

It is an object of the present invention to provide a novel, highly versatile cake decoration that can be used to celebrate various occasions such as birthdays, anniversaries, graduations and the like.

Another object of the invention is to provide a cake decoration of the aforementioned character that can be partially embedded in the upper surface of the cake and partially iced over so as to simulate a face that has moving eyes and a moving mouth, thereby humanizing the cake or like products, by simulating movement of lips in the manner of a human singing.

Another object of the invention is to provide a cake decoration as described in the preceding paragraphs that includes a battery powered sound generator that can play a number of different songs and greetings to fit the celebration.

Another object of the invention is to provide a cake decoration on the class described that is of a relatively simple construction and one that is easy to use.

Another object of the invention to provide such a cake decoration that is highly reliable in use and after the celebration can be readily salvaged and reused.

These and other objects of the invention will be achieved by the novel cake decoration illustrated in accompanying drawings and described in the specification that follows.

DESCRIPTION OF THE INVENTION

Figure 1:
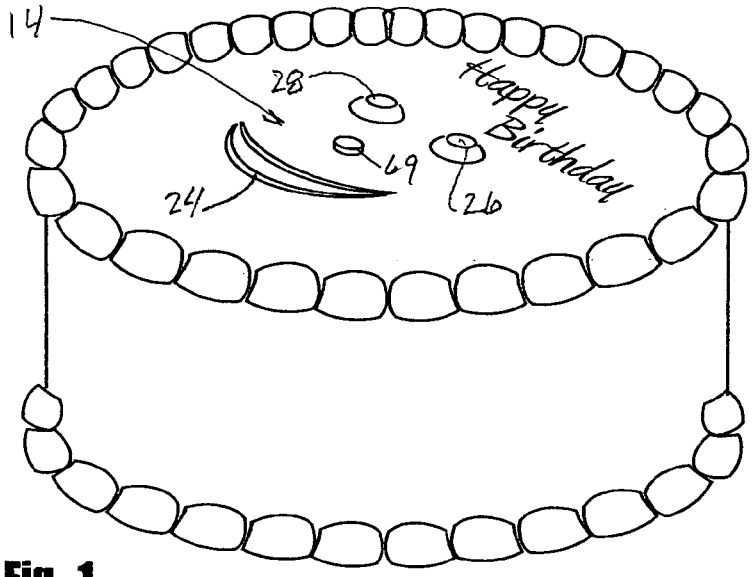
FIG. 1 is a generally perspective view of the cake showing the cake decoration of the present invention in position within the upper portion of the cake.

Referring to the drawings and particularly to FIGS. 1 through 4, one form of the cake ornament of the present invention is there shown and generally identified by the numeral 14. Cake ornament 14 here comprises a hollow housing 16 (FIGS. 4 and 5) that includes a first elevated portion 16*a* having a mouth like aperture 18 and a second elevated portion 16*b* that includes first and second spaced apart eye sockets 20 and 22. An intermediate, lower housing portion 16*c* is disposed between and interconnects first and second elevated portion housings 16*a* and 16*b* (FIG. 5).

Figure 4:
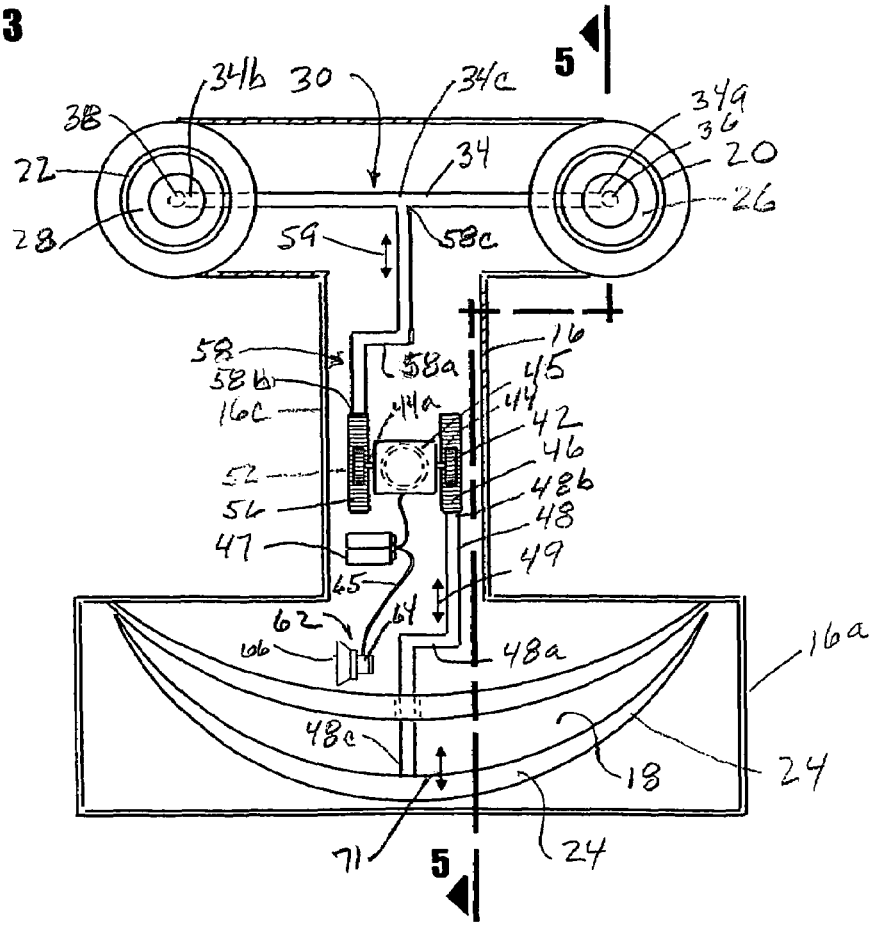
FIG. 4 is a top plan view of the cake decoration illustrating one form of the operating mechanism of the apparatus.
Figures 5, 5A, 5B, 5C:
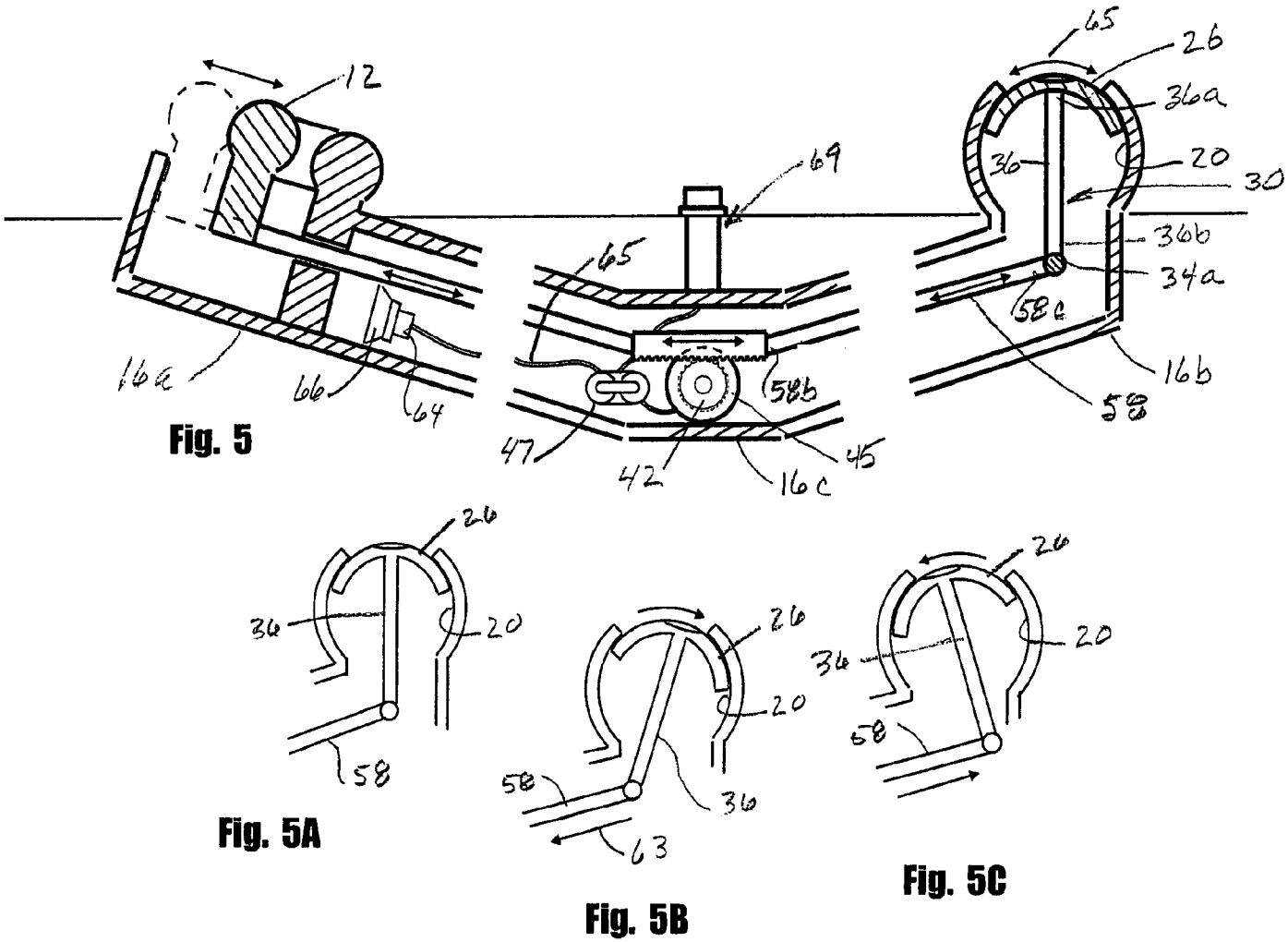
FIG. 5 is a greatly enlarged, foreshortened cross-sectional view taken along lines 5-5 of FIG. 4.
FIGS. 5A, 5B and 5C when considered together illustrate the movement of the simulated eye of the device within the eye socket of the apparatus shown in FIG. 5.

As best seen in FIGS. 4 and 5 of the drawings, a first curved member 24 that simulates a human lip is disposed within mouth aperture 18 for movement between a first position shown by the dotted lines in FIG. 5 and a second position shown by the solid lines in FIG. 5. First curved member 24 is movable by means of a first actuating means that is mounted within the housing and is operably associated with said first curved member 24 for causing said first curved member 24 to controllably move between the first position and the second position to simulate opening and closing of the mouth. The construction and operation of the first actuating means will presently be described.

Figure 2:
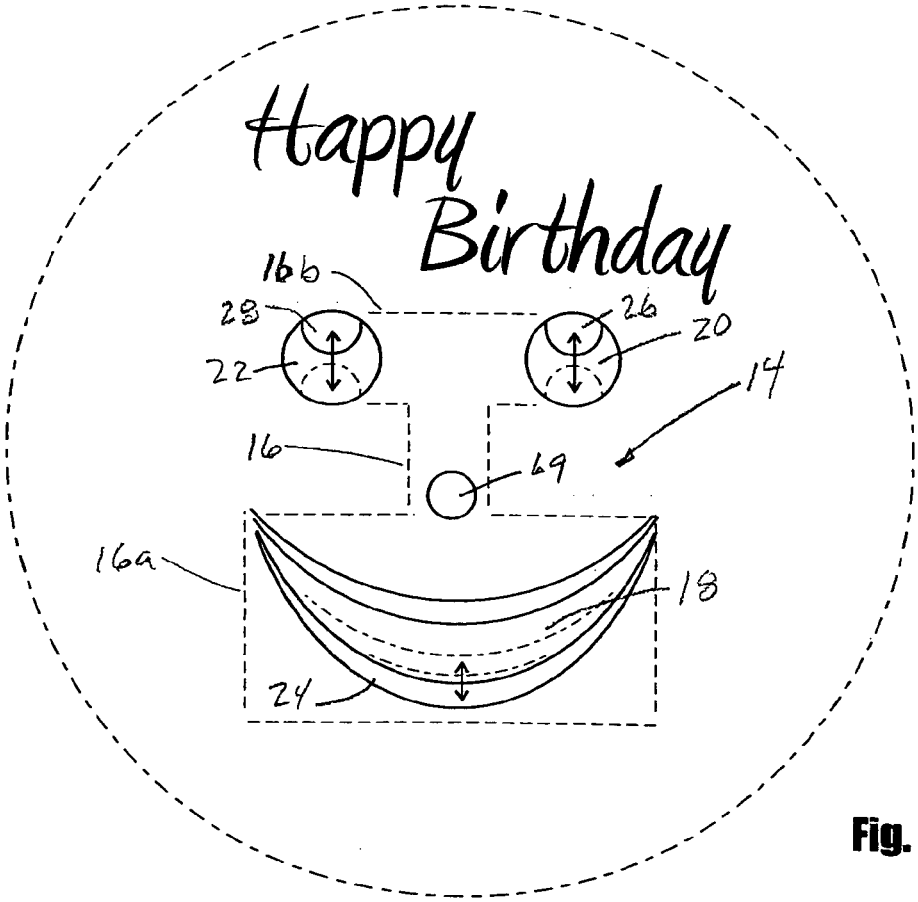
FIG. 2 is a top plan, diagrammatic view illustrating the movement of the mouth and eyes of the apparatus.

A second curved member 26 that simulates an eyeball is disposed within the first eye socket 20 for movement by a second actuating means between a first position shown by the dotted lines in FIG. 2 and a second position shown by the solid lines in FIG. 2. Similarly, a third curved member 28 that also simulates an eyeball is disposed within the second eye socket 22 for movement by the second actuating means between a first position shown by the dotted lines in FIG. 2 and a second position shown by the solid lines in FIG. 2. The construction and operation of the second actuating means will presently be described.

A cross member assembly 30 interconnects the second and third curved members 26 and 28 in the manner shown in FIGS. 4 and 5 of the drawings. As best seen in FIGS. 4 and 5, cross member assembly 30 comprises a transversely extending cross member 34 having first and second ends 34*a* and 34*b*. Cross member assembly 30 also includes a first link 36 having a first end 36*a* connected to second curved member 26 and a second end 36*b* that is pivotally connected to first end 34*a* of cross member 34. A second link 38 that is of similar construction and operation to first link 36 interconnects the third curved member 28 with cross member 34 (see FIG. 4) so that it can pivot relative to the cross member in the same manner as does first link 36 (see FIGS. 5A, 5B and 5C).

Figure 3:
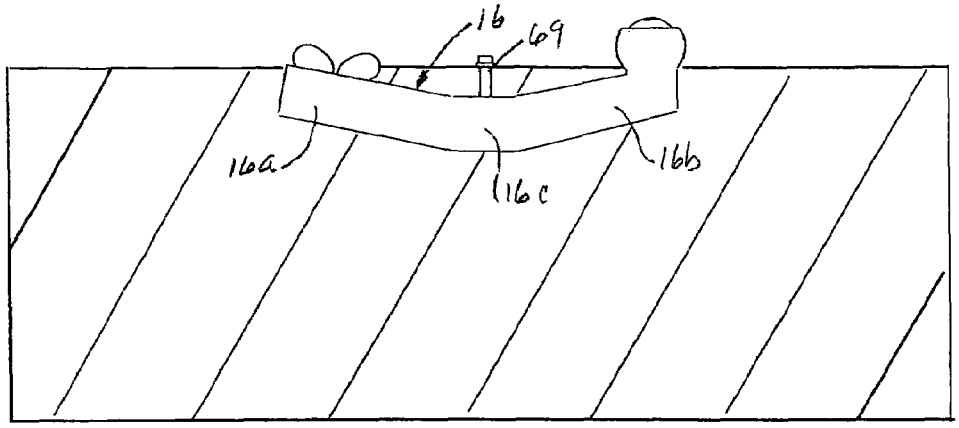
FIG. 3 is a longitudinal cross-sectional view of the cake illustrated in FIG. 1, further illustrating one form of the cake decoration of the invention in position within the upper portion of the cake.

In the present form of the invention, the first actuating means comprises a rotatable member 42, shown here as a pinion gear that is connected to the first end of the rotating shaft 44 of a conventional electric motor 45 powered by a pair of dry cell batteries 47. Motor 45 and pinion gear 42, which is rotated about a transverse axis defined by rotating shaft 44, are mounted within the intermediate portion 16*c* of the housing 16 (FIG. 3). As indicated in FIGS. 4 and 5 of the drawings, pinion gear 42 mates with and reciprocally drives a rack 46 that, in turn, reciprocally drives a first connector member 48 in the manner indicated by the arrows 49 in FIG. 4. Connector member 48 which has an offset 48*a* also has a first-end 48*b* that is connected to rack 46 and a second end 48*c* that is connected to first curved member 24 that simulates a human lip.

In the present form of the invention, the second actuating means comprises a rotatable member 52, shown here as a pinion gear that is connected to the second end of the rotating shaft 44 of electric motor 45. As indicated in FIGS. 4 and 5 of the drawings, pinion gear 52 mates with and reciprocally drives a rack 56 that, in turn, reciprocally drives a second connector member 58 in the manner indicated by the arrows 59 in FIG. 4. Connector member 58 which has an offset 58*a*, also has a first-end 58*b* that is connected to rack 56 and a second end 58*c* that is connected to cross member 34 proximate its center 34*c*.

An important feature of the cake ornament of the present invention is the provision of a sound generator 62 that is carried by housing 16 for generating a sound. Sound generator 62 can generate various sounds including spoken words and selected musical scores. The sound generator can take on various forms well understood by those skilled in the art, but here comprises integrated circuit chip 64 that is connected to batteries 47 by means of a cable 65 and is programmed to play a selected musical score through a piezoelectric speaker 66.

As indicated in FIG. 5 of the drawings, a conventional, readily commercially available on/off slide switch 69 is provided for actuating and de-actuating the motor 44 and the sound generator 62. Switch 69 is carried by the intermediate portion of housing 16 and, as shown in FIG. 5, extends to the exterior surface of the housing. Switch 69 can be covered with a nose like design cover or similar design.

In using the apparatus of the invention, the housing 16 is carefully inserted into the center of the cake to the position illustrated in FIGS. 1 and 3 wherein the mouth, eyes and switch 69 protrude slightly from the upper surface of the cake. While the cake shown in FIG. 1 is generally round in cross-section, it is to be understood that the apparatus of the invention can be used with cakes of various configurations including rectangular, triangular, oblong, and the like.

Operation of switch 69, by exerting a downward pressure on the switch, activates both the motor 44 and the sound generator 66. Activation of the motor causes the shaft to controllably rotate, which in turn causes controlled rotation of pinion gears 42 and 52. Rotation of the pinion gears imparts a controlled reciprocal motion to racks 46 and 56 causing movement of the simulated lip 24 and the eye sockets 26 and 28. More particularly, the reciprocal motion of rack 56 will impart reciprocal motion to member 48 causing the lip 24 to reciprocate in the manner indicated by the arrow 71 of FIG. 4, thereby simulating opening and closing of the mouth.

In similar manner, the reciprocal motion of rack 56 will impart reciprocal motion to member 58 causing it to reciprocate in the manner indicated by the arrow 59 of FIG. 4. This reciprocal motion of member 58 will cause cross member 34 to reciprocate in a manner illustrated in FIGS. 5A, 5B and 5C of the drawings. As the cross member moves in the manner indicated by the arrow of 63 of FIG. 5B, the simulated eyeballs 26 and 28 will move within their respective sockets in the manner indicated by the arrow 65 of FIG. 5, thereby simulating a rolling of the simulated eyeballs of the apparatus.

At the same time that the lip and eye sockets move, the sound generator will generate words such as "happy birthday", "happy anniversary" and the like and may also generate music appropriate to the particular celebration at hand.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A cake ornament comprising:

(a) a hollow housing including a first portion having a mouth aperture, a second portion having a first eye socket and a second spaced apart eye socket and an intermediate portion;

(b) a first curved member simulating a lip disposed within said mouth aperture for movement between a first position and a second position;

(c) a first rotatable member mounted within said intermediate portion of said housing for rotary movement about a transverse axis;

(d) a first connector assembly interconnecting said first curved member with said first rotatable member for moving said first curved member between said first position and said second position;

(e) a second curved member simulating an eyeball disposed within said first eye aperture for movement between a first position and a second position;

(f) a third curved member simulating an eyeball disposed within said second eye aperture for movement between a first position and a second position;

(g) a cross member assembly interconnecting said second and third curved members, said cross member assembly being movable between first and second positions to cause each of said second and third curved members to move between said first and second positions;

(h) a second rotatable member mounted within said intermediate portion of said housing for rotary movement about a transverse axis; and (i) a second connector assembly interconnecting said cross member assembly and said first rotatable member for moving said cross member assembly between said first and second positions.

2. The cake ornament as defined in claim 1 further including a sound generator connected to said housing for playing selected musical scores while said first and second rotatable members rotate.

3. The cake ornament as defined in claim 2, in which said sound generator comprises at least one integrated circuit chip connected to said battery and programmed to play a selected musical score through a piezoelectric speaker.

4. The cake ornament as defined in claim 2, further including an electric motor mounted within said housing and operably interconnected with said first and second rotatable members for controllably rotating said members.

5. The cake ornament as defined in claim 4, in which said electric motor includes a driveshaft having first and second ends, in which said first rotatable member comprises a first pinion gear connected to said first end of said driveshaft and in which said second rotatable member comprises a second pinion gear connected to said second end of said driveshaft.

6. The cake ornament as defined in claim 5 in which said first connector assembly comprises an elongated first rack operably associated with said first pinion gear and in which said second connector assembly comprises an elongated second rack operably associated with said second pinion gear.

7. The cake ornament as defined in claim 6 in which said first connector assembly further comprises a first connector member interconnecting said first rack with said first curved member and in which said second connector assembly comprises a second connector member interconnecting said second rack with said cross member assembly.

8. The cake ornament as defined in claim 7 in which said electric motor is powered by a battery which is actuated by an on/off switch mounted on said housing.

9. A cake ornament comprising:

(a) a hollow housing including a first portion having a mouth aperture, a second portion having a first eye socket and a second spaced apart eye socket and an intermediate portion;

(b) a first curved member simulating a lip disposed within said mouth aperture for movement between a first position and a second position;

(c) an electric motor mounted within said intermediate portion of said housing, said motor having an elongated shaft rotatable about a transverse axis and having first and second ends;

(d) a dry cell battery mounted within said immediate portion of said housing and operably interconnected with said electric motor;

(e) a first pinion gear mounted on said first end of said shaft for rotary movement about said transverse axis;

(f) a first connector assembly interconnecting said first curved member with said first pinion gear for moving said first curved member between said first position and said second position, said first connector assembly comprising an elongated first rack operably associated with said first pinion gear;

(g) a second curved member simulating an eyeball disposed within said first eye aperture for movement between a first position and a second position;

(h) a third curved member simulating an eyeball disposed within said second eye aperture for movement between a first position and a second position;

(i) a cross member assembly interconnecting said second and third curved members, said cross member assembly being movable between first and second positions to cause each of said second and third curved members to move between said first and second positions;

(j) a second pinion gear mounted on said second end of said shaft for rotary movement about a transverse axis;

(k) a second connector assembly interconnecting said cross member assembly and said first pinion gear for moving said cross member assembly between said first and second positions, said second connector assembly comprising an elongated second rack operably associated with said second pinion gear; and (l) a sound generator connected to said housing for playing selected musical scores while said first and second pinion gears rotate, said sound generator means comprising at least one integrated circuit chip connected to said battery and programmed to play a selected musical score through a piezoelectric speaker.

10. The cake ornament as defined in claim 9 in which said first connector assembly further comprises a first connector member interconnecting said first rack with said first curved member and in which said second connector assembly comprises a second connector member interconnecting said second rack with said cross member assembly.

* * * * *